US005222256A

United States Patent [19]

Wang

[11] Patent Number: 5,222,256

[45] Date of Patent: Jun. 29, 1993

[54] KNEE OR ELBOW PAD

[75] Inventor: Tien-Ching Wang, Kaohsiung, Taiwan

[73] Assignee: Chang Yang Business Enterprise Co., Ltd., Tainan Hsuan, Taiwan

[21] Appl. No.: 940,070

[22] Filed: Sep. 3, 1992

[51] Int. Cl.[5] ..... A41D 13/06; A41D 13/08; A41D 27/12

[52] U.S. Cl. ..... 2/24; 2/16; 2/267; 602/20; 602/26

[58] Field of Search ..... 2/16, 22, 23, 24, 59, 2/60, 267, 268, 2; 602/20, 25, 26

[56] References Cited

U.S. PATENT DOCUMENTS

| | | | |
|---|---|---|---|
| 3,902,482 | 9/1975 | Taylor | 602/26 X |
| 4,245,629 | 1/1981 | Cummins | 602/26 X |
| 4,484,361 | 11/1984 | Leighton et al. | 2/24 |
| 4,751,748 | 6/1988 | Ekins | 2/24 X |
| 4,884,561 | 12/1989 | Letson, Sr. | 602/20 X |
| 5,038,763 | 8/1991 | Wiggins | 602/26 X |
| 5,107,823 | 4/1992 | Frotesi | 602/26 X |

FOREIGN PATENT DOCUMENTS

| | | | |
|---|---|---|---|
| 3626005 | 2/1988 | Fed. Rep. of Germany | 2/24 |
| 3905837 | 9/1989 | Fed. Rep. of Germany | 2/24 |

*Primary Examiner*—Clifford D. Crowder
*Assistant Examiner*—Jeanette E. Chapman
*Attorney, Agent, or Firm*—Pro-Techtor International

[57] ABSTRACT

A knee or elbow pad comprising an inverted U-shaped stable member and two trapezoidal curved movable members symmetrically combined with the stable member by means of rivets to function as pivots to permit the movable members to move to spread or contract in relation to the stable member so that the pad can bend or straighten to conform to the position of a knee or an elbow of a wearer when the knee or the elbow is bent or straightened.

1 Claim, 10 Drawing Sheets

KNEE OR ELBOW PAD

BACKGROUND OF THE INVENTION

Traditional common knee or elbow pads generally comprise a stable plastic cover and a flat cotton pad on which the stable plastic cover is sewn, protecting the knee or elbow of a wearer. But they have an disadvantage which they have not enough flexibity for a knee or elbow to bend so that the wearer cannot feel very natural in bending his knee or elbow. In the result, he can hardly wear it for a long time.

SUMMARY OF THE INVENTION

The knee or elbow pad in the present invention has been improved to have an inverted U-shaped stable member and two trapezoidal curved movable members combined symmetrically with the stable member so that the two movable members can spread out or contract in in relation to the stable member to conform the condition of a knee or elbow of a wearer when the knee or elbow is bent or straightened.

The knee or elbow pad is sewn on an intermediate portion of a cotton pad to protect a knee or elbow of a wearer.

DETAILED DESCRIPTION OF THE INVENTION

Figure 8:
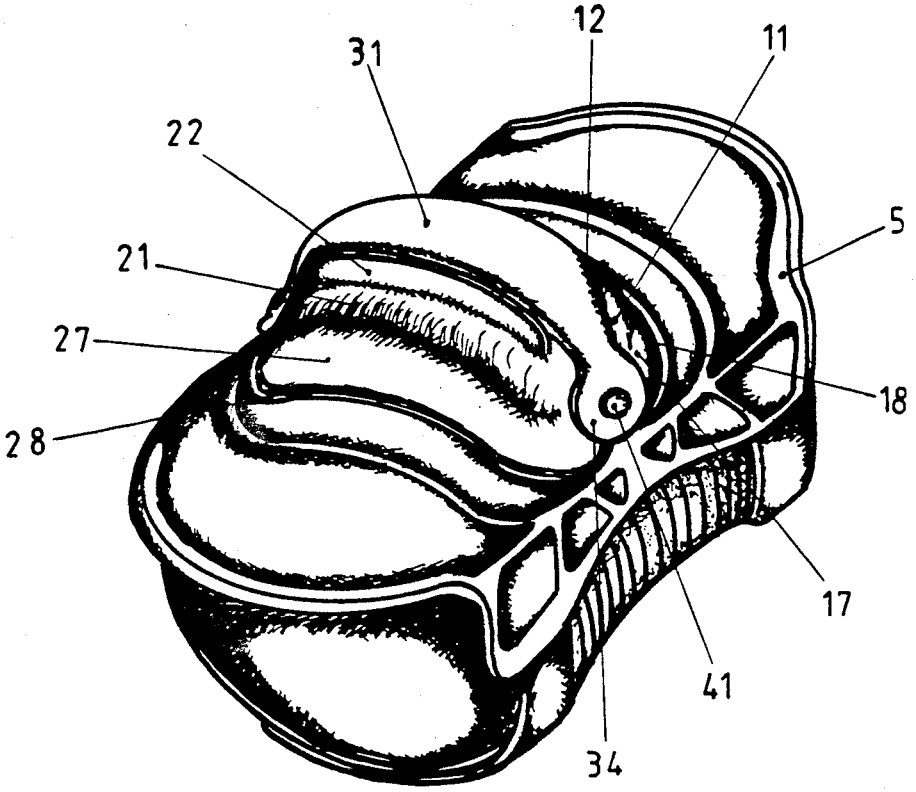
FIG. 8 is perspective view of the knee or elbow pad sewn on a cotton in the present invention.
Figure 9:
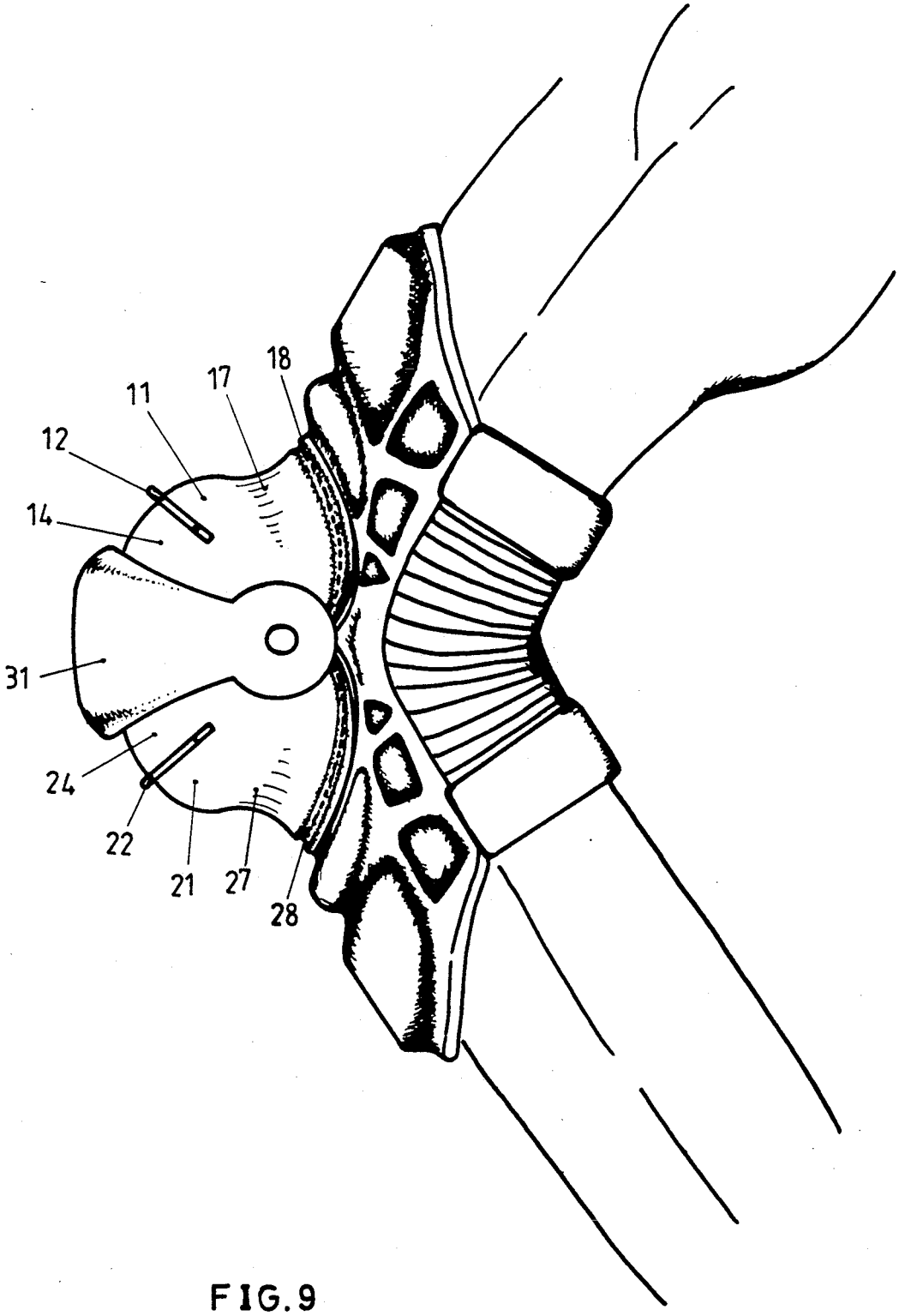
FIG. 9 is a perspective view of the knee or elbow pad sewn on a cotton pad worn on an elbow.
Figure 10:
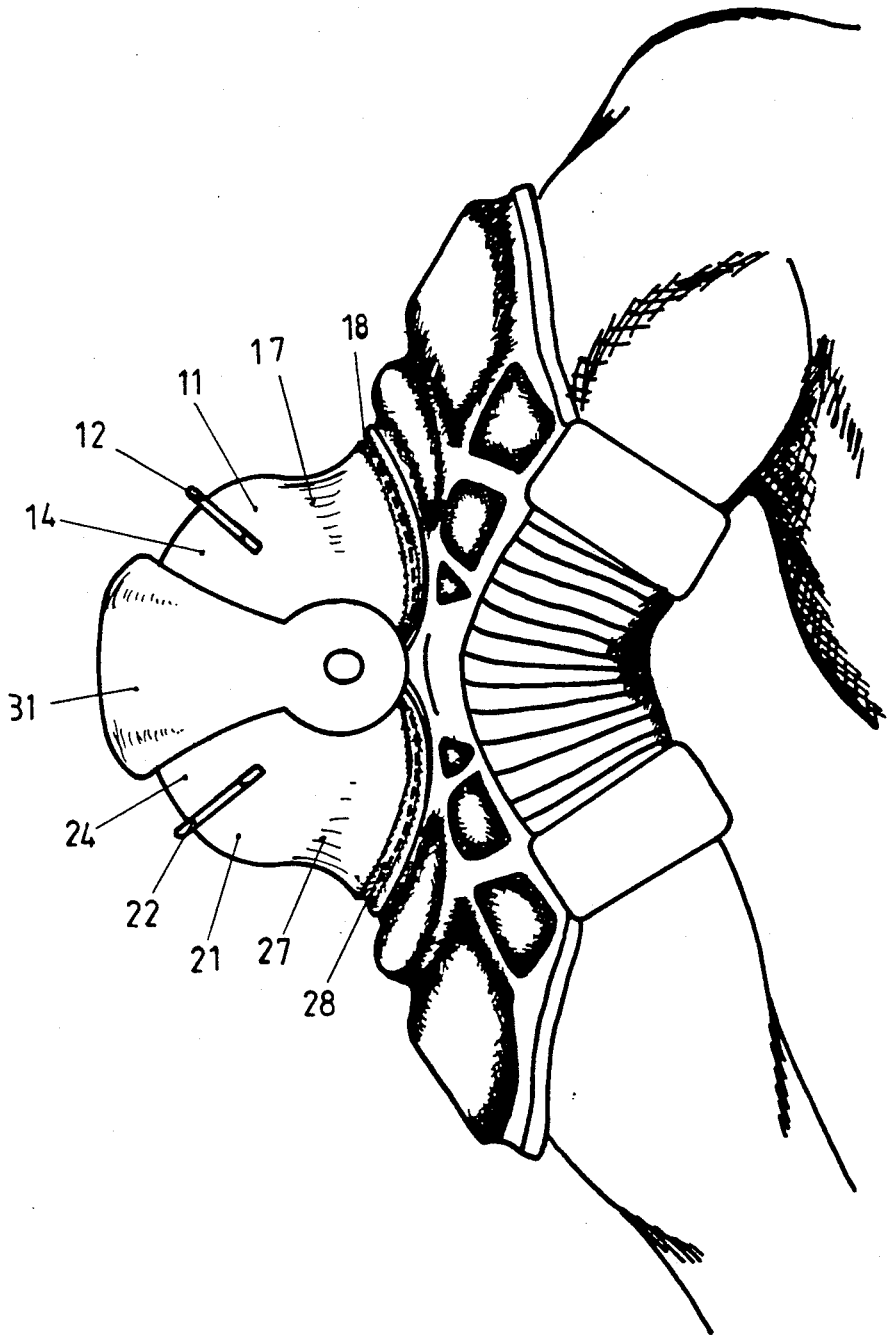
FIG. 10 is a perspective view of the knee or elbow pad sewn on a cotton pad worn on a knee.

A knee or elbow pad to be sewn on an intermediate portion of a cotton pad 5 in the present invention, as shown in FIG. 8 is to be used by a sportsman, being worn on his knee or elbow to protect it from being hurt and quite flexible to bend outward or inward or to straighten easily.

Figure 1:
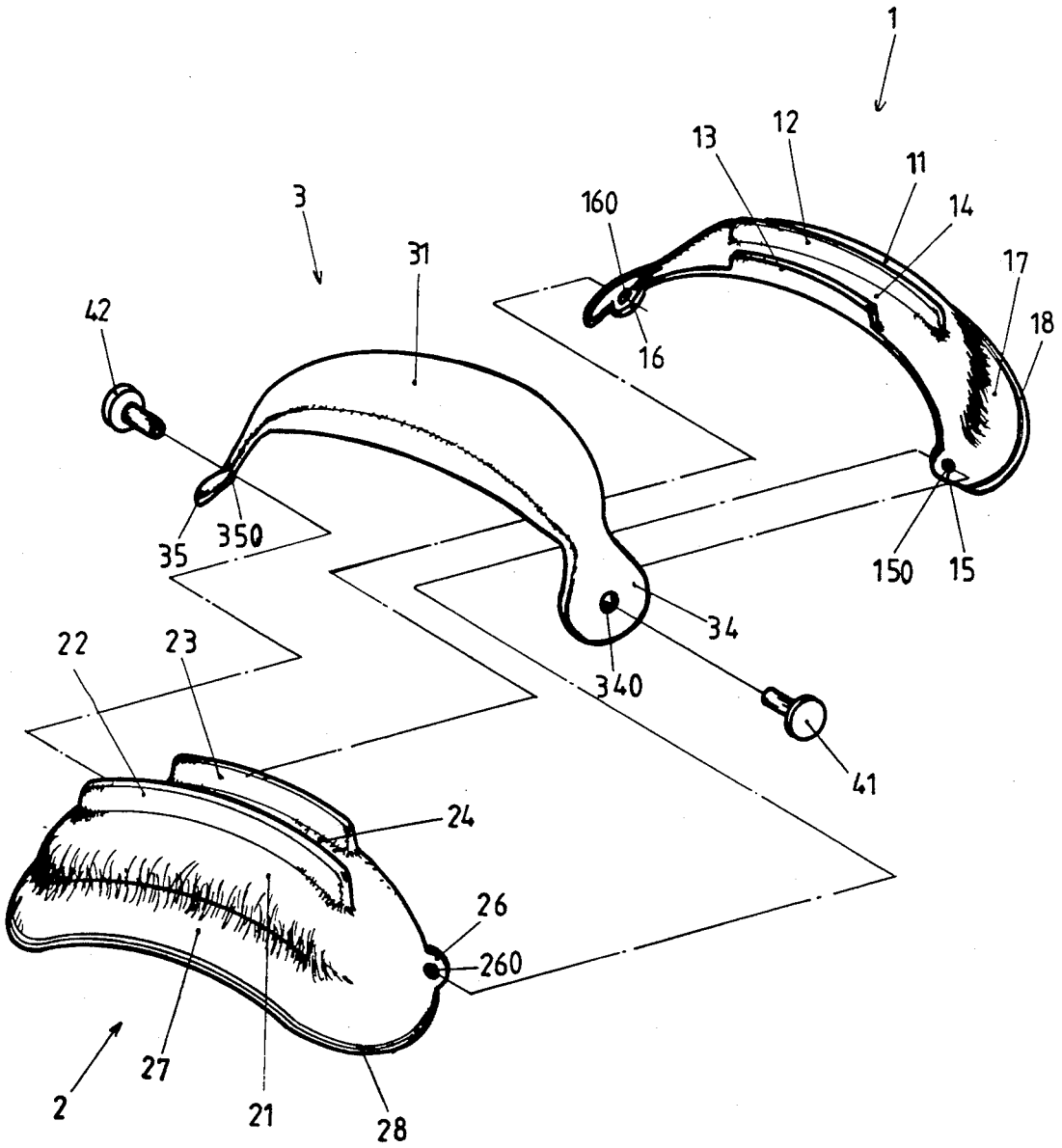
FIG. 1 is an exploded perspective view of a knee or elbow pad in the present invention.
Figure 2:
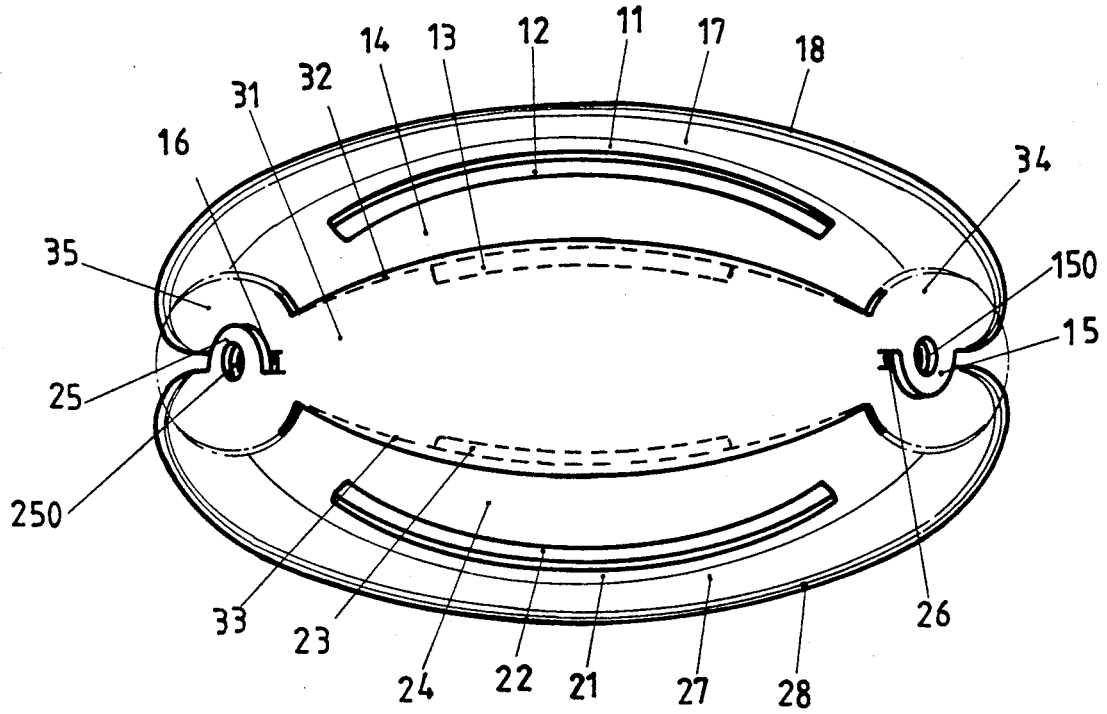
FIG. 2 is an upside view of the knee or elbow pad in the present invention.
Figure 3:
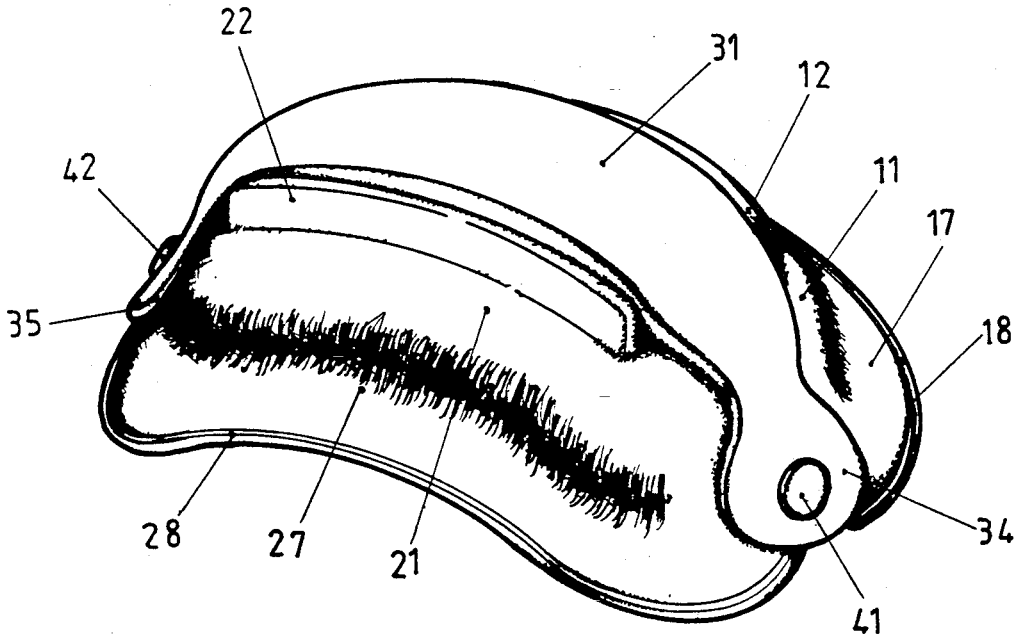
FIG. 3 is a perspective view of the knee or elbow pad in the present invention.

The knee or elbow pad in this invention, as shown in FIGS. 1 and 2 comprises two trapezoidal curved movable members 1, 2 and an inverted U-shaped stable member 3.

The trapezoidal curved movable members 1, 2 have declined-down crosswise portions 17, 27, grooves 18, 28 along a front edge for sewing the trapezoidal curved members 1, 2 on an intermediate portion of a cotton pad 5, curved portions 11, 21 provided crosswise in an intermediate portion, two front curved crosswise blocking fences 12, 22 and two rear curved crosswise blocking fences 13, 23 on the intermediate portion, fitting openings 14, 24 defined by both the front and the rear blocking fences 12, 22, 13, 23 for two bending edges 32, 33 of the stable member 3 to fit therein and end joining portions 15, 16, 25, 26 having rivet holes 150, 160, 250, 260. Then the trapezoidal curved movable members 1, 2 are symmetrically combined with the inverted U-shaped stable member 3 with rivets 41, 42 passing through rivet holes 340, 350, 150, 260, 160, 250 so that the curved members 1, 2 can spread out and contract in in relation to the stable member 3.

The inverted U-shaped stable member 3 has a curved covering portion 31, two end joining portions 34, 35 bored with rivet holes 340, 350 and two bending edges 32, 33 along the front and the rear end. The bending edges 32, 33 fit in the fitting openings 14, 24 in the trapezoidal curved members 1, 2 so that the two members 1, can move to spread out or to contract within the distance between the two pairs of fences 12, 13, 23, 24. When the stable member 3 is combined with the two members 1, 2 rivets 41, 42 are used to secure them together so that the two members 1, 2 can move with the rivets as pivots.

After the two members 11, 2 are combined with the stable member 3, then the two members 1, 2 are to be sewn on an intermediate portion of a cotton pad 5 with a string stitched along the grooves 18, 28 as shown in FIG. 8.

Figure 4:
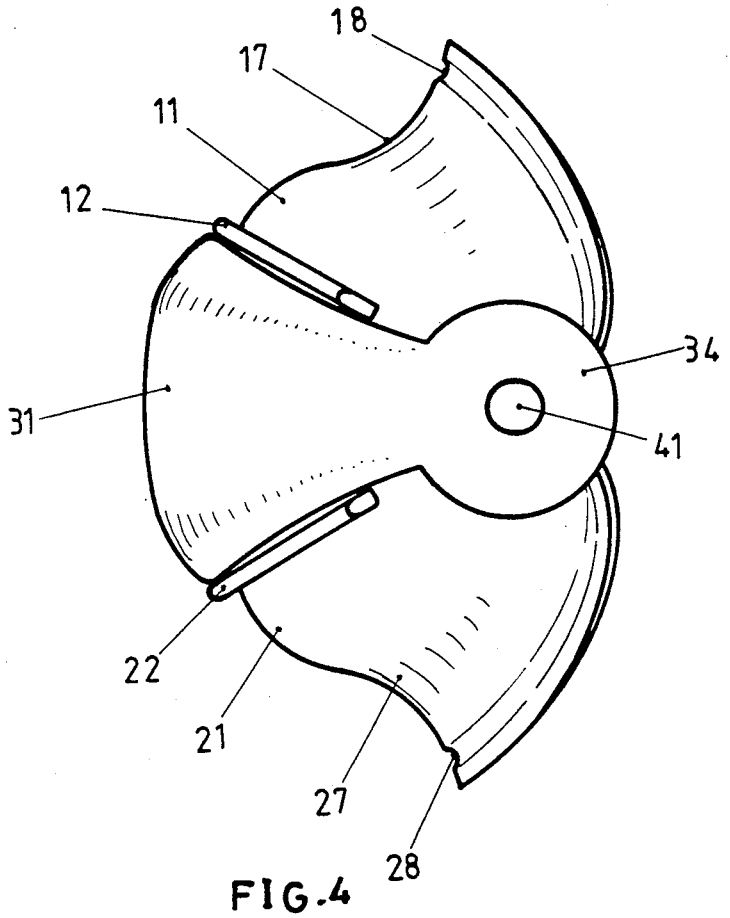
FIG. 4 is a side view of the knee or elbow pad in a contracted condition in the present invention.
Figure 5:
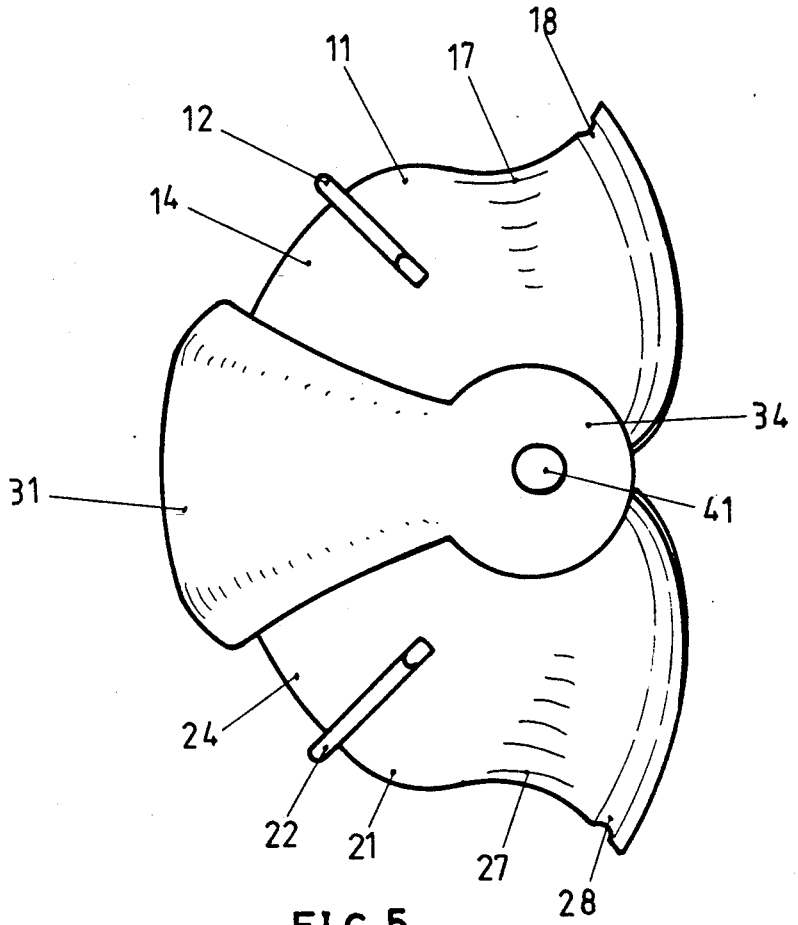
FIG. 5 is a side view of the knee or elbow pad in a spread-out condition in the present invention.
Figure 6:
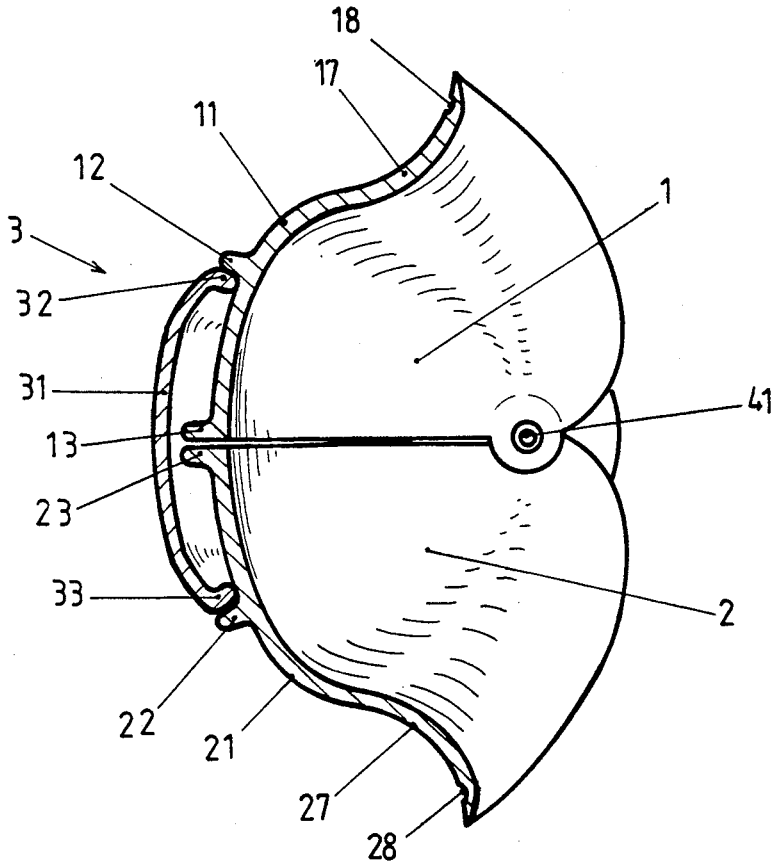
FIG. 6 is a cross-sectional view of the knee or elbow pad in a contracted condition in the present invention.
Figure 7:
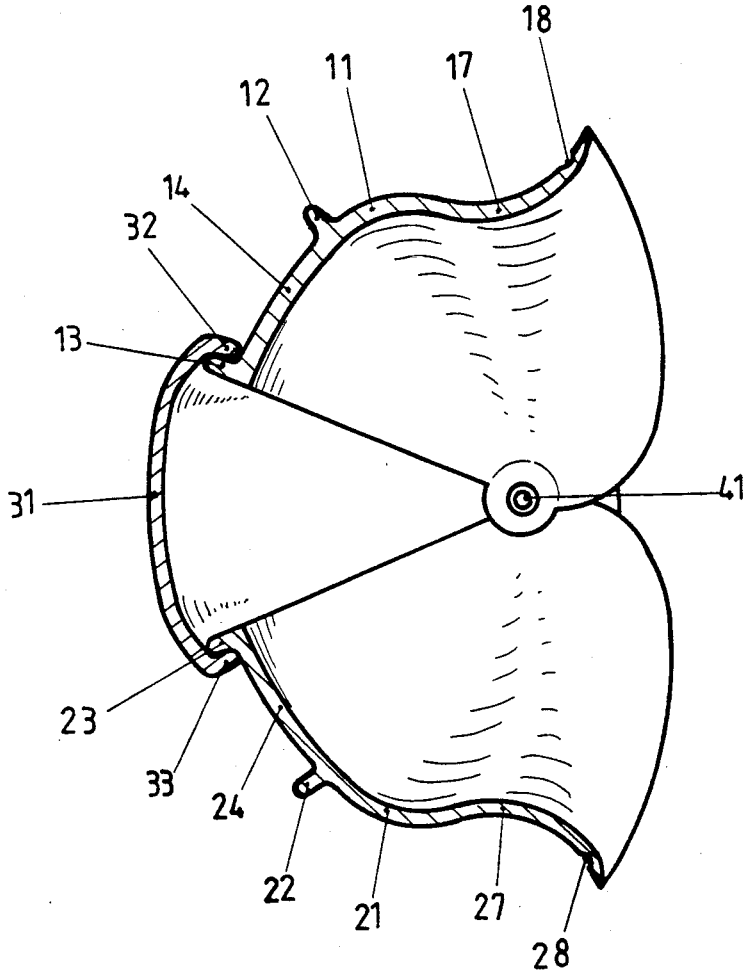
FIG. 7 is a cross-sectional view of the knee or elbow pad in a spread-out condition in the present invention.

When an elbow or knee wearing this pad is straightened up, the two movable members 1, 2 contract to touch with each other, the stable member 3 covers the fixing openings 14, 24, and the two bending edges 32, 33 are blocked by the front blocking fences 12, 22 of the two members 1, 2 as shown in FIGS. 4 and 6.

When the elbow or the knee wearing this pad is bent, the two movable members 1, 2 are moved to spread out, and the bending edges 32, 33 of the stable member 3 are blocked by the rear blocking fences 13, 23 of the two members 1, 2, as shown in FIGS. 2, 5, 7, 9, and 10, so the condition of this pad is conformed to the bent elbow or the knee.

What is claimed is:

1. A knee or elbow pad comprising:

an inverted U-shaped stable member having a curved covering portion, two bending crosswise edges extending inward to fit and move lengthwise in fitting openings in two trapezoidal curved movable members, two end joining portions respectively bored with a rivet hole;

two trapezoidal curved movable members to be combined symmetrically with said inverted U-shaped stable member, respectively having a curved crosswise portion, a front and rear curved crosswise blocking fence spaced apart in an intermediate portion, a fitting opening defined by said front and rear blocking fences for the two bending crosswise edges to fit and move therein, a declined crosswise portion opposite the curved crosswise portion, a groove along a bottom edge, and two end joining portions respectively bored with a rivet hole; and said two trapezoidal curved movable members which spread and contract in relation to said stable member with rivets as pivots when the pad is worn on a knee or elbow and the knee or elbow is bent and straightened, said two movable members being sewn on an intermediate portion of a cotton pad, said bending edges of said stable member being blocked by the front blocking fences of said movable members when the knee or elbow is straightened, said bending edges of said stable member being blocked by the rear blocking fences of said movable members when the knee or elbow is bent, said movable members thus being moved to spread and contract in relation to said stable member to conform to the position of the knee or elbow when it is bent and straightened.

* * * * *